US006471006B2

(12) United States Patent
Hulkkonen et al.

(10) Patent No.: US 6,471,006 B2
(45) Date of Patent: Oct. 29, 2002

(54) METHOD IN THE HYDRAULIC ROLL CONTROL SYSTEM OF A PAPERMAKING MACHINE OR THE LIKE AND A MULTIPRESSURE HYDRAULIC ROLL CONTROL SYSTEM

(75) Inventors: Matti Hulkkonen, Vaajakoski (FI); Juha Lahtinen, Jyväskylä (FI); Esa Salavamäki, Muurame (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/962,060

(22) Filed: Sep. 25, 2001

(65) Prior Publication Data

US 2002/0046905 A1 Apr. 25, 2002

Related U.S. Application Data

(63) Continuation of application No. PCT/FI00/00240, filed on Mar. 23, 2000.

(30) Foreign Application Priority Data

Mar. 26, 1999 (FI) ..... 990672

(51) Int. Cl.[7] ..... F01M 1/00
(52) U.S. Cl. ..... 184/6.21; 162/199
(58) Field of Search ..... 184/6.21, 6.22, 184/6.24, 104.1; 162/199, 252

(56) References Cited

U.S. PATENT DOCUMENTS

| | | | | |
|---|---|---|---|---|
| 4,209,079 A | | 6/1980 | Marchal et al. | |
| 4,726,691 A | | 2/1988 | Lehmann | |
| 4,970,767 A | * | 11/1990 | Link | 29/116.2 |
| 5,813,496 A | * | 9/1998 | Hyvönen et al. | 184/6.4 |

FOREIGN PATENT DOCUMENTS

| | | |
|---|---|---|
| DE | 3909556 A1 | 11/1989 |
| WO | WO 00/58637 | 10/2000 |

* cited by examiner

*Primary Examiner*—David Fenstermacher
(74) *Attorney, Agent, or Firm*—Lathrop & Clark LLP

(57) ABSTRACT

Oil is pumped from a tank (10) to points of service in the hydraulic roll control system of a papermaking machine, wherein the oil is pumped at least at one low pressure level such as is required for the lubrication of the roll bearings and/or drive gearbox and at least at one high pressure level such as is required for the pressure-loaded zones of a roll. The oil is filtered and if necessary cooled and the return circulation of oil is passed back to the tank (10). The oil is pumped from the tank (10) into a single low-pressure circuit by a pump or pumps (11*a*, 11*b*), with a capacity to meet overall demand of fluid flows delivered to the points of service. Supply lines form the circuit to desired points of service are passed through stages to stepwise elevate the line pressure to a desired high-pressure level.

3 Claims, 5 Drawing Sheets

PRIOR ART

PRIOR ART

METHOD IN THE HYDRAULIC ROLL CONTROL SYSTEM OF A PAPERMAKING MACHINE OR THE LIKE AND A MULTIPRESSURE HYDRAULIC ROLL CONTROL SYSTEM

CROSS REFERENCES TO RELATED APPLICATIONS

This application is a continuation of PCT Application No. PCT/FI00/00240, filed Mar. 23, 2000, and claims priority on Finnish Application No. 990672, filed Mar. 26, 1999, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a method for use in the hydraulic roll control system of a papermaking machine or the like, in which method oil is pumped from a supply tank to points of service, wherein the oil is pumped at least at one low pressure level such as is required for the lubrication of the roll bearings and/or drive gearbox and at least at one high pressure level such as is required for pressure-loaded zones of a roll and in which pressurized system the oil being pumped is filtered and if necessary cooled and in which system the return circulation of oil from the points of service is passed back to the supply tank.

The invention further relates to a multipressure hydraulic roll control system suited for use in a papermaking machine or the like, in which system the oil is arranged to be pumped from a supply tank to the points of service at least at one low pressure level such as is required for the lubrication of the roll bearings and/or drive gearbox and at least at one high pressure level such as is required for the pressure-loaded zones of a roll and in which multipressure system the oil being pumped is filtered and if necessary cooled prior to being passed to the points of service and in which system the return circulation of oil from the points of service is arranged to be passed back to the supply tank.

A plurality of functions are today implemented in papermaking mills with the help of hydraulics. One of the most important hydraulics applications herein is the crown compensation of rolls. Furthermore, e.g., the adoption of long-nip presses in fast-running papermaking machines and the growing favor of covered rolls needing improved cooling circulation has pushed hydraulic roll control systems to dimensions corresponding to those of circulating oil lubrication systems. When implemented using conventional constructions and components, the overall costs of circulating fluid systems have increased steeper than could be anticipated from a linear extrapolation of costs on the basis of nominal pumping capacity required. Another factor urging toward larger systems is the adoption of large-scale hydraulic power supply centers serving a plurality of rolls in common. On new papermaking lines, there may be a great number of crown-compensated rolls, whereby the present convention of providing each roll with a dedicated hydraulic control center is an expensive solution for the system manufacturer and, frequently, for the end user, too. Revamping a mill with larger hydraulic systems is often hampered by the problem of finding sufficient footprint for a single hydraulic fluid supply tank. Hence, a need exists to manage with smaller supply tanks and simultaneously develop the technology and manufacture of larger systems toward higher cost efficiency.

The inception of the method and system according to the invention builds on the state of the art that is first explained by making reference to FIG. 1 illustrating at a very schematic level the principles of a typical circulating oil lubrication system. In a system of the kind shown herein, the hydraulic oil is taken from a supply tank 50, wherefrom it is distributed by means of a hydraulic pump 51*a* to lubricated points. The system also includes a standby pump 51*b* and check valves 52 required thereto. From the pump 51*a*, the hydraulic oil is taken advantageously via a two-way valve 53 and further via filters 54 and a cooler 55 to the lubricated points along a feed line denoted by reference numeral 56. The system pressure is regulated with the help of a bypass flow controlled by means of a two-way valve 57 wherefrom the return flow is directed back to the supply tank 50 along a piping line 58. The return flow of oil from the system to the supply tank 50 takes place along a return line 59.

Another example of the state-of-the art systems is shown in FIG. 2 illustrating a typical hydraulic system of a roll equipped with spray piping. In the conventional system shown in this diagram, an oil tank 60 is divided into two parts, whereby the tank is comprised of a return oil chamber 60*a* and a suction chamber 60*b*. The main reason for this two-compartment division is that as the supply pressure to the valve manifold of controlled-crown rolls is generally about 85 bar typical, coolers used for cooling the oil cannot be mounted directly on the supply lines, because standard-type coolers are specified for a maximum working pressure of about 25 bar. Consequently, the oil is cooled in a separate filtering/cooling circuit into which the oil is passed by a hydraulic pump 61*a*. Next to the pump 61*a*, the circulating oil is passed in a conventional manner through a filter 62*a*. A standby pump is denoted by reference numeral 61*b* and at filter connected thereto by reference numeral 62*b*, while the check valves required are denoted by reference numerals 63. Next to these, the filtering/cooling circuit is provided with a cooler 64 after which the forward flow 66 to the spray piping is taken with the help of suitable arrangements from a manifold 65. The manifold 65 is further connected by a line 67 to the suction chamber 60*b* of the oil tank 60 so that the oil can be supplied from the return oil chamber 60*a* to the filtering/cooling circuit and exhausted therefrom back to the suction chamber 60*b*. The oil to be passed to a high-pressure circuit 74 connected to the control valve manifold of the roll is taken from the suction chamber 60*b* via a pump 71*a* and a filter block 73. In FIG. 2, a standby pump of this circuit is denoted by reference numeral 71*b* and the check valves by reference numeral 72. Respectively, the oil supplied to the roll bearings and the drive gearbox is passed by a pump 81 a via a filter block 83. In this circuit, a standby pump is denoted by reference numeral 81*b* and the check valves by reference numeral 82. A return flow pipe back to the oil tank 60 is denoted by reference numeral 68.

The return oil chamber 60*a* forms about 60% of the overall volume of the tank 60. The volume of the return oil chamber 60*a* is effectively utilized, e.g., for separating entrained air bubbles from the oil. The suction chamber 60*b* serves only partially as the active volume of the tank 60, whereby it makes the tank dimensions larger but also functions as an internal manifold of the tank 60. Because roll control systems frequently need a high cooling power, the flow rate pumped through the filter 62*a*, 62*b* of the filtering/cooling circuit must be equal to the maximum flow rate of oil to be pumped through the actuators. This means that the oil returning from the roll is filtered twice before it is resupplied to the system. Such an almost double-capacity filtering arrangement imposes substantial extra costs on both the system manufacturer as well as the end user operating the system.

Improvements to the conventional system shown in FIG. 2 have been sought, e.g., from stripping off unnecessary filtering capacity. Still adhering to the elucidation of the state of the art, said approach is depicted in FIG. 3 illustrating a system comprising a low-pressure circuit 104 and a high-pressure circuit 114, complemented with a cooling circuit in which oil is taken by a hydraulic pump 91 from the return oil chamber 90*a* of supply tank 90 and passed via a cooler 93 and a check valve 92 along a return flow line 94 back to the suction chamber 90*b* of the tank. This arrangement omits the filtering circulation of FIG. 2 and hence has only the cooling circuit. However, all oil being pumped to the roll is filtered immediately after pumps 101*a*, 101*b*, 111*a* and 111*b*. Of these, pumps 101*b* and 111*b* serve as standby pumps.

At large flow rates, the most advantageous technique of implementing run-time replacement of filters has constituted a parallel connection of multiple filters in which the filters can be replaced one at a time. In FIG. 3, the filter banks are denoted by reference numerals 103 and 113. The valves and check valves of the low-pressure and high-pressure circuits are denoted by reference numerals 102, 105, 106, 112, 115 and 116, respectively. As mentioned above, the supply tank 90 still incorporates a suction chamber 90*b* serving as an oil distribution manifold between the separate low-pressure and high-pressure circuits 104, 114. A return flow pipe of oil exhausted from the roll control system is denoted by reference numeral 118 in FIG. 3.

In the above-described systems representing the state of the art, a major problem arises from the large size of the oil supply tank required therein and the great number of components necessary to implement the desired functions. The high-pressure circuits of conventional systems need coolers as well filters that are extremely costly. In addition to cost and size factors, prior-art systems are also hampered by the complicated constructions of the oil system.

SUMMARY OF THE INVENTION

It is an object of the present invention to provide an entirely novel type of method suited for use in the hydraulic roll control system of a papermaking machine or the like. To reach this goal, the method according to the invention is principally characterized in that in the method the oil is pumped from a tank by means of a pump or pumps into a single low-pressure circuit wherefrom the supply lines to desired points of service are passed through stages serving to stepwise elevate the line pressure to a desired high-pressure level.

The delivery of the low-pressure primary circuit pump or pumps is advantageously adapted to meet the overall demand of oil flows delivered to the points of service.

It is another object of the invention to provide a novel type of multipressure hydraulic roll control system designed according to a new concept. This kind of multipressure hydraulic control system is principally characterized in that the multipressure system is implemented as a single low-pressure circuit and is provided with a distribution manifold or manifolds through which the oil flows are adapted to pass toward the points of service essentially at the working pressure level of the low-pressure circuit and/or at pressure levels higher than that of the primary circuit by virtue of stepwise elevating the line pressure to the desired higher level with the help of a high-pressure pump or pumps.

In a multipressure system, the delivery of the low-pressure pumps feeding the oil from the tank to the low-pressure primary circuit is advantageously adapted to meet the overall demand of oil flows delivered to the points of service.

The method and the multipressure hydraulic roll control system according to the invention gives a significant advantage over conventional arrangements. Firstly, the invention facilitates a simplified construction of the oil tank as the tank need not any more include a separate return oil chamber and a suction chamber. Hence, the outer dimensions as well as the overall volume of the tank can be made smaller without departing from the design rules of equal system capacity. Furthermore, the invention manages with simpler filtering equipment. By virtue of the method and system according to the invention, the cooling circuit is easier to control, because the temperature of the oil flowing to the field points of service remains more constant. The adoption of the invention eliminates pressure drop losses due to unnecessary pressure elevation, since the low-pressure flows can be taken from a low-pressure primary circuit while the high-pressure lines are connected to a high-pressure circuit, respectively. The location of pumps can be made with greater freedom and at a greater distance from the oil tank than in the prior art as the pressurized oil distribution manifold assures a sufficiently high suction head at the pump inlets. The invention is also superior to the prior art by permitting the use of a cylindrical tank if its manufacture is found more advantageous than making a cubic tank. The manufacture of the tank is easier as less nozzles are required thereon. Other benefits and specifications of the invention will be evident from the detailed description of the invention whereby reference will be made to the appended drawings marked FIGS. 4 and 5.

DESCRIPTION OF THE PREFERRED EMBODIMENTS

Figure 1:
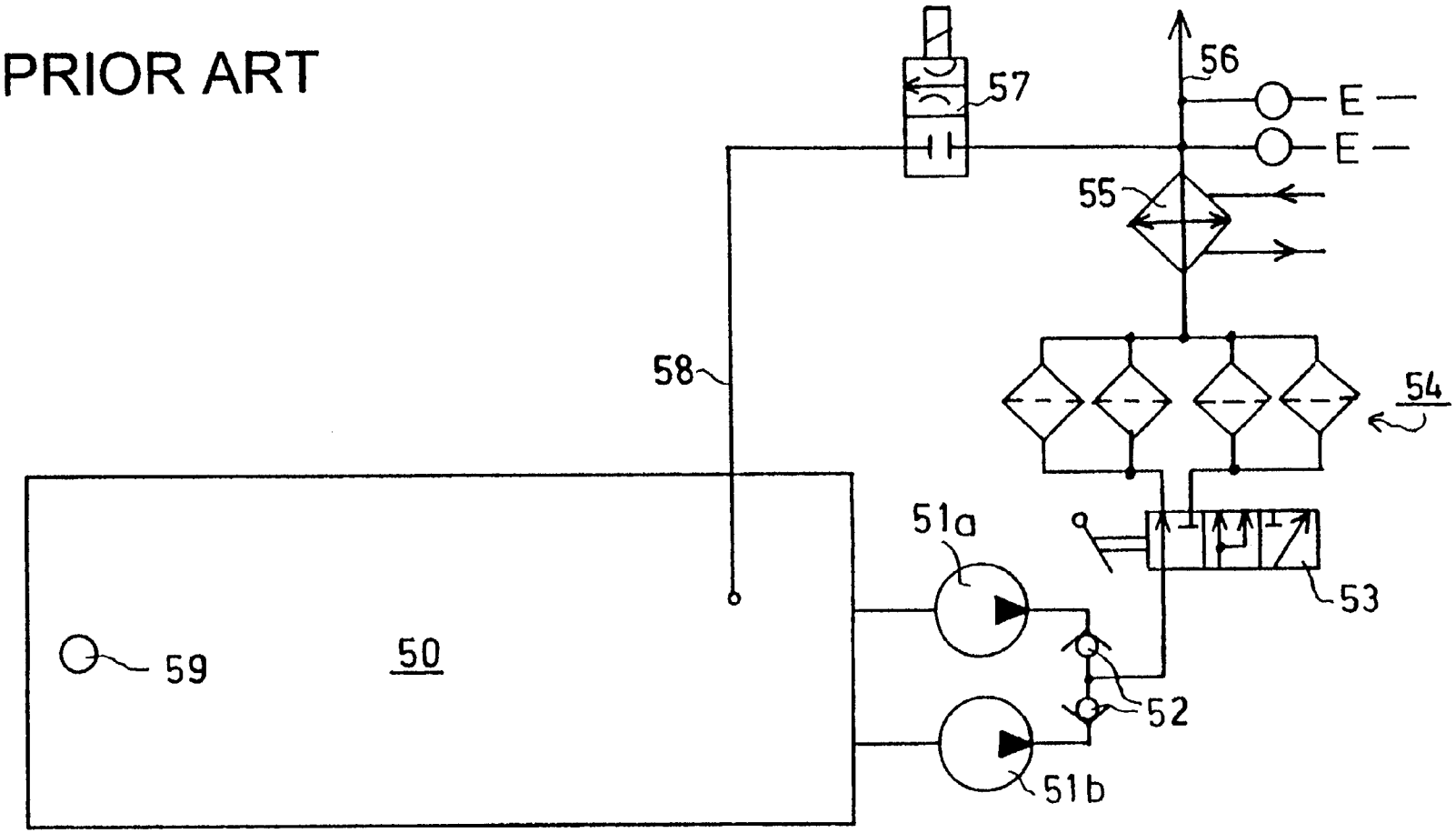
PRIOR ART FIG. 1
FIG. 1 is a schematic view of a prior art system.
Figure 2:
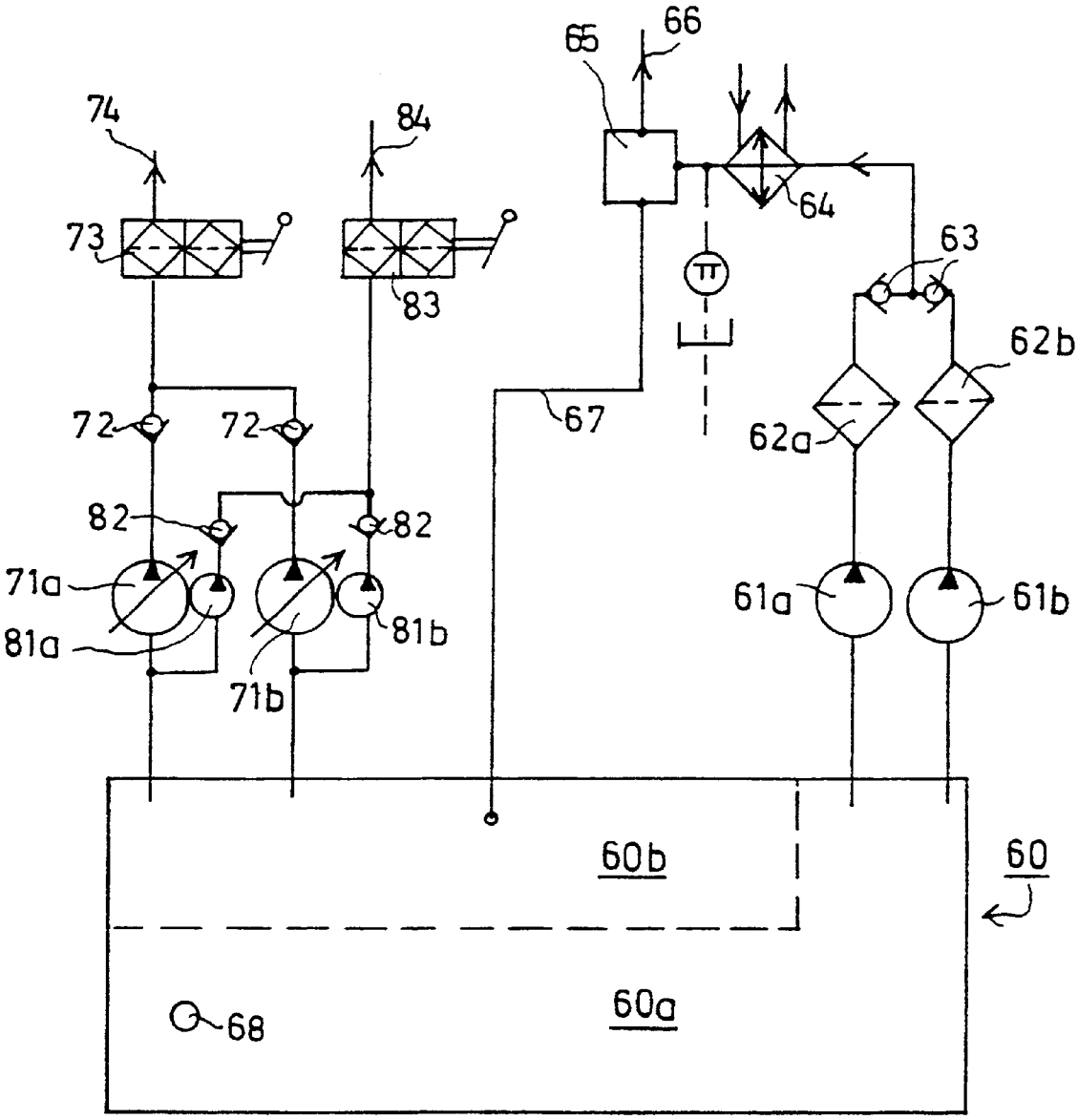
FIG. 2 is a schematic view of another prior art system.
Figure 3:
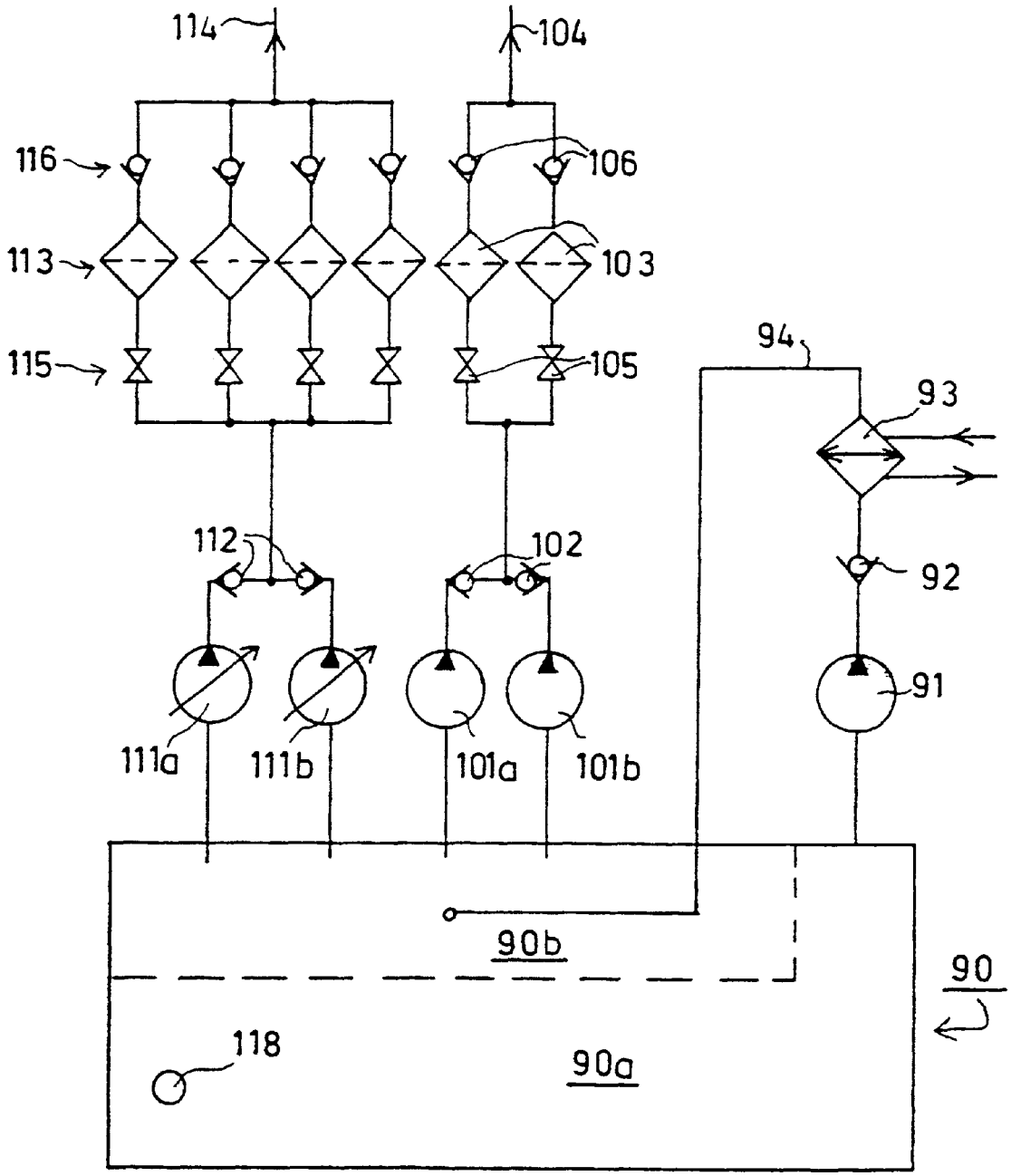
FIG. 3 is a schematic view of yet another prior art system.
Figure 4:
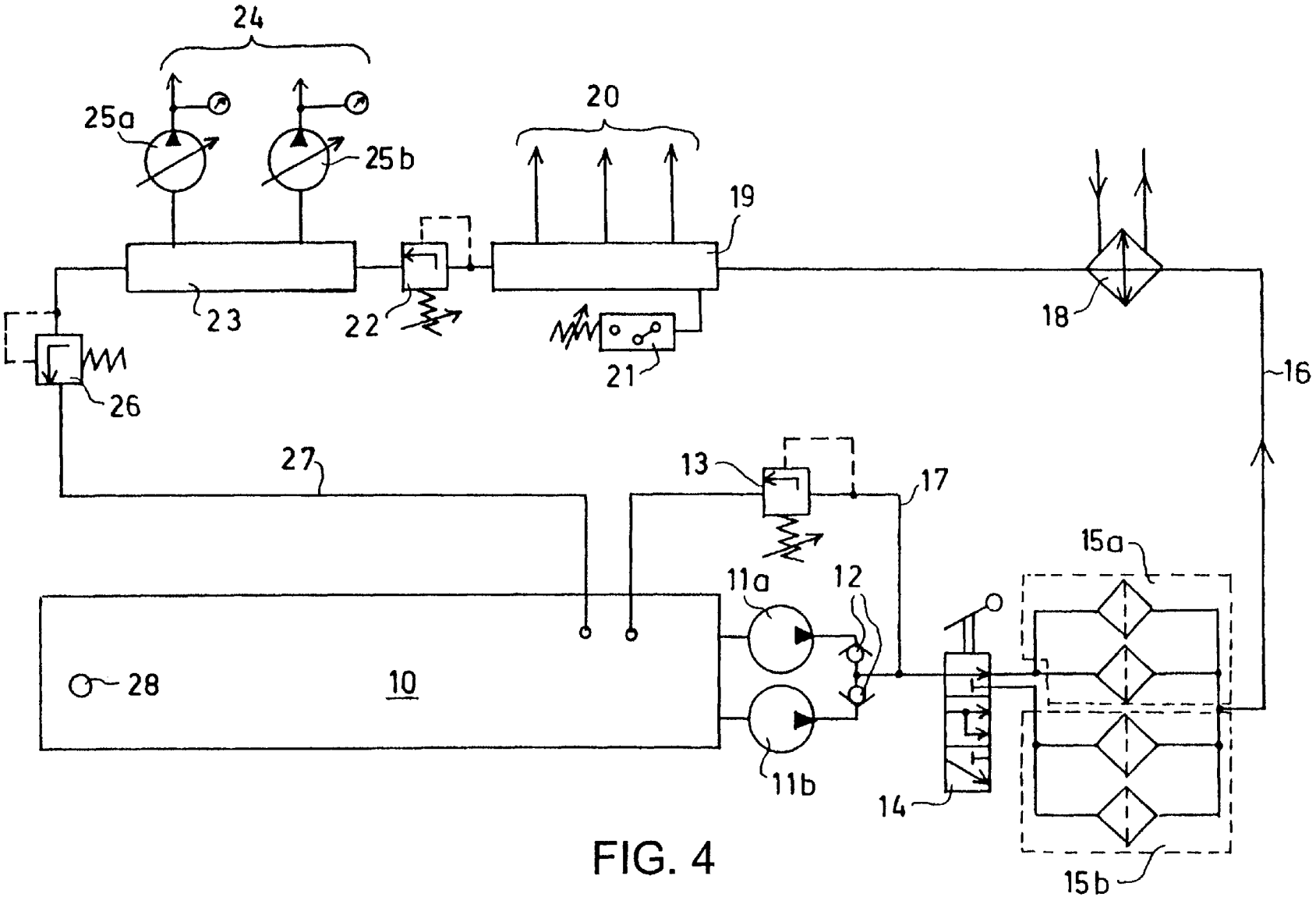
FIGS. 4 and 5 of the drawing illustrate schematically alternative embodiments of hydraulic roll control systems according to the invention.
Figure 5:
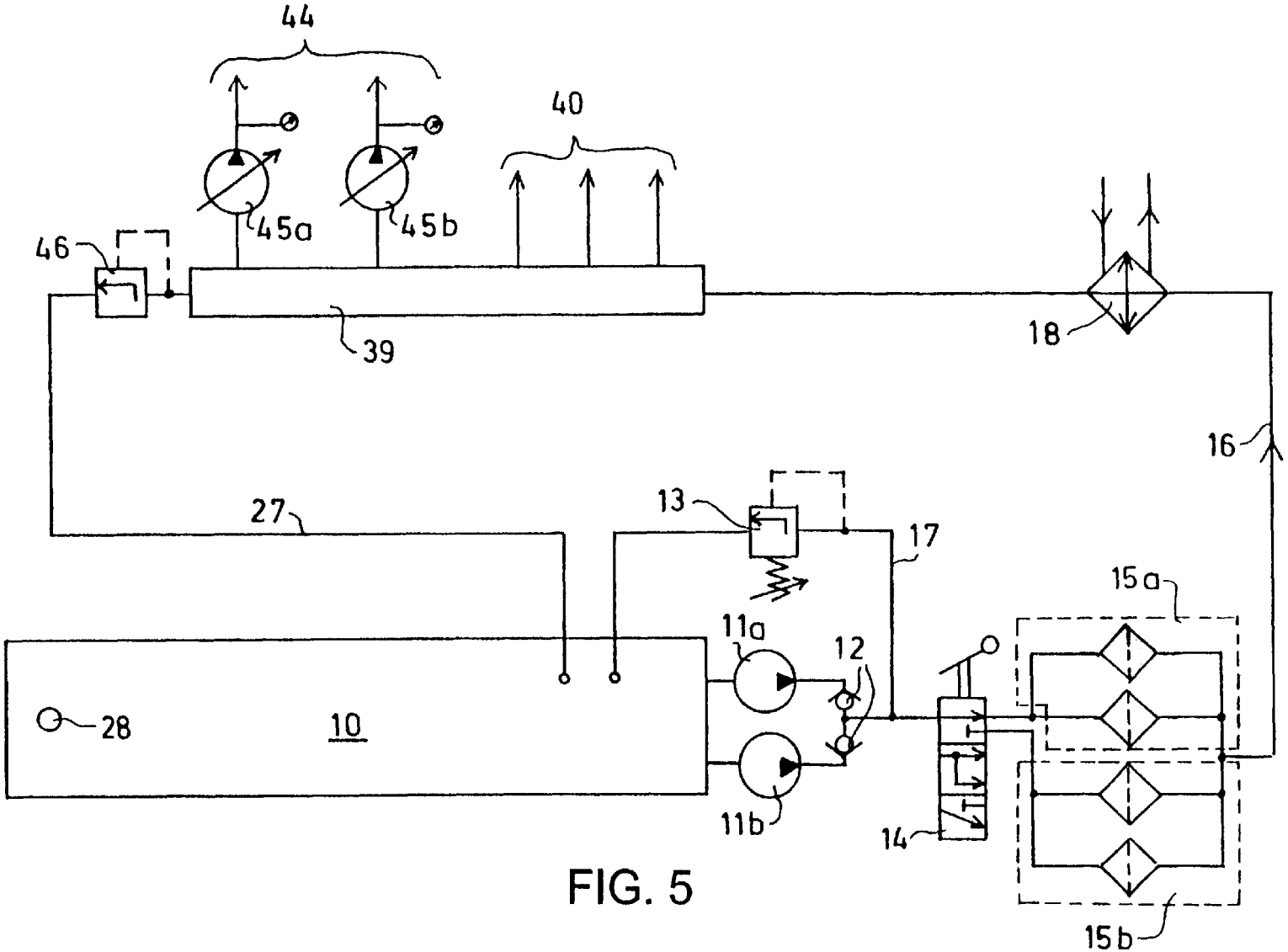

Initially, reference is made to both FIG. 4 and 5 of the drawing that are elaborated to the extent they may have common features. In FIGS. 4 and 5, the oil tank of the hydraulic system is denoted by reference numeral 10. Advantageously, the tank 10 is a cylindrical vessel. As compared to prior-art systems (cf. FIGS. 2 and 3), the conventional two-chamber tank is replaced by a single-chamber tank 10 having a total volume equal to the return oil chamber volume in the prior-art system tank. While both the drawings, that is, FIGS. 4 and 5, illustrate a dual-pressure embodiment of the invention, it is evident to those skilled in the art that this is only for the purpose of greater clarity in the diagrams and, obviously, the system may as well deliver oil at multiple different pressure levels if so required. In the schematic layouts of FIGS. 4 and 5, the general principle is to filter and cool the oil in the low-pressure primary circuit and then elevate the line pressure to the input pressure level required by the control valves of the roll compensation zones with the help of high-pressure pumps supplied by the low-pressure pumps. No filtration of the oil occurs after the high-pressure pumps. Hence, as shown in FIGS. 4 and 5, the oil is delivered from the tank 10 into the circulation by means of a hydraulic pump 11*a* which is a low-pressure pump. A standby pump is denoted by reference numeral 11*b* and the necessary check valves by reference numeral 12. The system and particularly the delivery of its low-pressure pump 11*a* are dimensioned so that the pump delivery can always meet the overall demand of the oil flows to be delivered to field points of service. After the pump 11*a*, the system includes a pressure control circuit 17 whose pressure relief valve 13 serves to keep the line pressure at a desired level. Next, the oil flow is passed to filters that in the layouts of FIGS. 4 and 5 are connected in two filter blocks 15*a* and 15*b*. In front of the filter blocks is connected a two-way valve 14 by means of which it is possible to select either or both of the filter banks 15*a*, 15*b* to serve for oil filtration. This arrangement facilitates run-time replacement of the filters even during operation if so required. Next after the filters 15*a*, 15*b*, the pressure line 16 of the pressurized system is provided with a cooler 18 serving to bring the temperature of the hydraulic oil down to a desired level.

In the layout of FIG. 4, the oil is passed to a first distribution manifold 19 whose input port is thus supplied at the output pressure level of the low-pressure pumps 11*a*, 11*b*. Next, this first manifold 19 delivers the low-pressure flows 20 of the first pressure level whose hydraulic oil flows may be used, e.g., for lubricating the roll drive gearbox and bearings. The pressure level of these low-pressure flows may be 20 bar, for instance. The diagram of FIG. 4 also includes a pressure sensor 21 connected to the first manifold 19 for the purpose of serving in the pressure control of the first pressure level. From the first manifold 19, the hydraulic oil of the first pressure level is taken to a second manifold 23, wherefrom in the layout of FIG. 4 are delivered the oil flows 24 of the second pressure level. In the embodiment illustrated in FIG. 4, these flows of the second pressure level are high-pressure flows that are passed to the pressure-loaded zones of a roll, for instance. High-pressure hydraulic pumps 25*a*, 25*b* are used to elevate the working pressure of these flows to the desired level of, e.g., 80 bar. Advantageously, pump 25*b* serves as a standby pump. Hence, the suction side of the high-pressure pumps 25*a*, 25*b* is supplied at an oil pressure level substantially equal to the output pressure level of the low-pressure pumps 11*a*, 11*b*. In FIG. 4 is further shown a pressure-reducing valve 22 connected between the first manifold 19 and the second manifold 23. This pressure-reducing valve serves to keep the inlet pressure on the suction side of the high-pressure pumps at a suitable level. Thus, if the output pressure of the low-pressure pumps 11*a*, 11*b* should in some cases happen to be too high for feeding directly the suction side of the high-pressure pumps 25*a*, 25*b*, the pressure-reducing valve 22 can be set to limit the pressure at the input ports to a suitable level below the output pressure of the low-pressure pumps 11*a*, 11*b*. The excess flow of the overall delivery of the low-pressure pumps 11*a*, 11*b* is passed after the second manifold 23 via a relief valve 26 along a line 27 back to the tank 10. Respectively, the return oil flow from the roll is passed along a return line 28 back to the tank 10.

The embodiment shown in FIG. 5 differs from the embodiment of FIG. 4 therein that the latter embodiment uses a single, compact manifold 39, wherefrom the oil is taken to different points of service at a plurality of different pressure levels. Only two different pressure levels are drawn in FIG. 5, of which the flows of the first pressure level, that is, of the low-pressure circuit are denoted by reference numeral 40. Analogously to the description of FIG. 4 above, the pressure level of these low-pressure flows is, e.g., 20 bar typical and they may be used, e.g., for lubricating the roll drive gearbox and bearings. In FIG. 5 the flows of the second pressure level, i.e., the high-pressure flows are denoted by reference numeral 44 and the pressure level of these flows may be, e.g., in the order of 80 bar, whereby they are used as flows to be passed to the pressure-loaded zones of a roll. The working pressures of these second-level flows are elevated to the desired levels by means of high-pressure hydraulic pumps 45*a*, 45*b*, of which the latter pump 45*b* advantageously may serve as a standby pump. From the manifold 39, the excess delivery of the hydraulic oil is passed via a relief valve 46 along a line 27 back to the tank 10. Respectively, the return oil flow from the roll is passed along a return line 28 back to the tank 10.

In regard to the manifold construction and hydraulic power use, the embodiment shown in FIG. 5 is preferred over that of FIG. 4. The embodiment of FIG. 5 is suited for applications in which the suction side of the high-pressure pumps 45*a*, 45*b* can be directly supplied at the output pressure level of the low-pressure circuit. Generally, a pressure of 25 to 30 bar is permissible at the inlet ports of open-circulation piston pumps of most makes. In these cases, the embodiment of FIG. 5 is applicable. As to the hydraulic power needed to supply the low-pressure circuit, the embodiment of FIG. 5 offers improved power utilization efficiency over the embodiment of FIG. 4. A disadvantage in regard to the embodiment of FIG. 4 is that the variations in the oil flow rate over the pressure-elevation stage are larger which makes pressure stabilization more difficult. Obviously, it is possible to provide the low-pressure primary circuit with a load-sensing pressure control, whereby the supply pressure needs to be only slightly higher than the maximum line pressure to be delivered by the distribution manifold to the low-pressure circuit.

In the description of the examples illustrated in FIGS. 4 and 5, the pressurized fluid system is drawn to have only two working pressure levels, that is, the low-pressure flows on one hand and the high-pressure flows on the other hand. However, a single circuit may as well be arranged to deliver fluid at a plurality of different pressure levels that are stepwise elevated each to its own desired level, whereby a substantially improved hydraulic power efficiency is obtained. That portion of the hydraulic oil which is not passed out from the distribution manifold as low-pressure or high-pressure flows, respectively, is returned as back flow to the tank. In this manner, the oil needs to be filtered only once in the low-pressure primary circulation. For cold startups and oil filtration during shutdowns, the pressure elevation stages are provided with bypass circuits.

The above description, wherein reference is made to the embodiments shown in the appended drawings, is given by way of example only. To those skilled in the art, it is obvious that the invention is not limited by the embodiments illustrated in FIGS. 4 and 5, but rather, the different embodiments and modifications of the invention may be varied within the scope of the inventive spirit disclosed in the appended claims.

We claim:

1. A multipressure system for hydraulic roll control in a papermaking machine, comprising:

an oil tank having a single compartment;

at least one low pressure pump which draws oil from the oil tank compartment;

a first manifold carrying oil from the at least one low pressure pump to a plurality of points of service, the points of service including a plurality of roll bearing lubrications or drive gearbox lubrications;

at least one high pressure pump connected to receive oil from the at least one low pressure pump and to elevate the pressure of the oil received therefrom, oil being delivered from the high pressure pump to pressure-loaded zones of a hydraulic roll;

at least one pressure regulator positioned between the at least one low pressure pump and the at least one high pressure pump set to regulate oil pressure supplied to the high-pressure pump to between 20 bar and 30 bar; and at least one filter and at least one cooler positioned after the at least one low pressure pump and before the at least one high pressure pump, and wherein oil from the points of service is arranged to pass back to the oil tank, wherein the multipressure system is implemented as a single low-pressure circuit and wherein oil flows directly to the points of service essentially at the line pressure of the low-pressure circuit or at a pressure level higher than that of the primary circuit by virtue of stepwise elevating the line pressure with the help of the at least one high-pressure pump.

2. A method for use in the hydraulic roll control system of a papermaking machine comprising the steps of:

pumping oil with a first pump from a single reservoir to a first pressure;

passing the oil at the first pressure through a filter and a heat exchanger and lubricating a plurality of roll bearings and a gearboxes, also supplying oil which is passed through the filter and the heat exchanger to a second pump at a regulated pressure of 20 bar to 30 bar; and raising the pressure of the oil supplied to the second pump to on the order of 80 bar by means of the pump, and supplying oil at a pressure of on the order of 80 bar, to a plurality of crown-compensated rolls.

3. A multipressure system for hydraulic roll control in a papermaking machine, comprising:

an oil tank having a single compartment;

at least one low pressure pump which draws oil from the oil tank compartment;

a first manifold carrying oil from the at least one low pressure pump to a plurality of points of service, the points of service including a plurality of roll bearing lubrications or drive gearbox lubrications;

at least one high pressure pump connected to receive oil from the at least one low pressure pump and to elevate the pressure of the oil received therefrom, oil being delivered from the high pressure pump to pressure-loaded zones of a hydraulic roll;

at least one pressure regulator positioned between the at least one low pressure pump and the oil tank to regulate oil pressure supplied to the high-pressure pump to between 20 bar and 30 bar; and at least one filter and at least one cooler positioned after the at least one low pressure pump and before the at least one high pressure pump, and wherein oil from the points of service is arranged to pass back to the oil tank, wherein the multipressure system is implemented as a single low-pressure circuit and wherein oil flows directly to the points of service essentially at the line pressure of the low-pressure circuit or at a pressure level higher than that of the primary circuit by virtue of stepwise elevating the line pressure with the help of the at least one high-pressure pump.

* * * * *